US007524167B2

(12) United States Patent
Ohri et al.

(10) Patent No.: US 7,524,167 B2
(45) Date of Patent: Apr. 28, 2009

(54) COMBUSTOR SPRING CLIP SEAL SYSTEM

(75) Inventors: Rajeev Ohri, Winter Springs, FL (US); Plum Boonsuan, Greenville, SC (US)

(73) Assignee: Siemens Energy, Inc., Orlando, FL (US)

( * ) Notice: Subject to any disclaimer, the term of this patent is extended or adjusted under 35 U.S.C. 154(b) by 251 days.

(21) Appl. No.: 11/418,065

(22) Filed: May 4, 2006

(65) Prior Publication Data

US 2007/0258808 A1 Nov. 8, 2007

(51) Int. Cl.
*F01D 25/24* (2006.01)

(52) U.S. Cl. ..... 415/215.1; 277/544; 277/545; 277/546; 60/752; 60/800

(58) Field of Classification Search ..... 415/214.1; 60/752, 755–760, 800; 277/412, 544–546
See application file for complete search history.

(56) References Cited

U.S. PATENT DOCUMENTS

| | | | | |
|---|---|---|---|---|
| 2,991,045 | A | 7/1961 | Tassoni | |
| 4,602,795 | A | 7/1986 | Lillibridge | |
| 4,944,151 | A | 7/1990 | Hovnanian | |
| 5,088,888 | A | 2/1992 | Bobo | |
| 5,125,796 | A | 6/1992 | Cromer | |
| 5,143,292 | A * | 9/1992 | Corsmeier et al. | 239/127.3 |
| 5,158,305 | A | 10/1992 | Halling | |
| 5,320,487 | A | 6/1994 | Walker et al. | |
| 5,738,490 | A | 4/1998 | Pizzi | |
| 6,203,025 | B1 | 3/2001 | Hayton | |
| 6,334,310 | B1 * | 1/2002 | Sutcu et al. | 60/752 |
| 6,402,466 | B1 | 6/2002 | Burdgick et al. | |
| 6,446,977 | B1 | 9/2002 | Thiede | |
| 6,702,549 | B2 | 3/2004 | Tiemann | |
| 6,869,082 | B2 * | 3/2005 | Parker | 277/630 |
| 7,010,921 | B2 * | 3/2006 | Intile et al. | 60/752 |
| 7,284,378 | B2 * | 10/2007 | Amond et al. | 60/776 |
| 2004/0251639 | A1 | 12/2004 | Parker | |

FOREIGN PATENT DOCUMENTS

| | | |
|---|---|---|
| EP | 1 221 574 A2 | 7/2002 |
| JP | 07293276 A | 11/1995 |

* cited by examiner

*Primary Examiner*—Edward Look
*Assistant Examiner*—Sean J Younger

(57) ABSTRACT

Aspects of the invention are directed to a sealing system for the interface between a combustor liner and transition duct. The system includes a spring clip seal. A first end of the spring clip seal operatively engages the inner peripheral surface of the transition duct. A second end of the spring clip seal is indirectly attached to the liner by an insert disposed therebetween. The spring clip seal can be attached to the insert by any kind of welding process that does not involve melting of the spring clip seal and the insert, such as fillet welding. The insert and the liner can be attached in a similar manner. Because fillet welds are relatively easy to cut, the spring clip, insert and liner can be separated without the need for cutting any of these individual components. Thus, the system can facilitate the repair, disassembly and reassembly of the interface.

17 Claims, 7 Drawing Sheets

COMBUSTOR SPRING CLIP SEAL SYSTEM

FIELD OF THE INVENTION

The invention relates in general to turbine engines and, more particularly, to a sealing system for a turbine engine.

BACKGROUND OF THE INVENTION

FIG. 1 shows an example of a portion of the combustor section 10 of a turbine engine. Turbine engine performance can be adversely affected by fluid leakages that can occur in the combustor flow path. One area in which such leakage can occur is the annular gap 12 defined between the exit region 14 of the combustor liner 16 and the inlet region 18 of the transition duct 20. As is known, the annular gap 12 can be sealed by the use of a spring clip seal 22. Such seals 22 are generally cylindrical cones that taper from a first diameter to a second, smaller diameter. The first diameter of the spring clip seal 22 is operatively positioned against the transition duct 20, and the second, smaller diameter is fixedly attached to a combustor liner 16. The spring clip seal 22 can accommodate relative movement between the combustor liner 16 and the transition duct 20 while maintaining a seal.

Over the life of the engine, the combustor liner 16 and/or the spring clip seal 22 may require service or repair due to wear or other issues. However, known spring clip sealing systems can actually impede the repair process, causing extended downtime.

One of the known spring clip sealing systems is shown in FIG. 2. The second diameter 24 of the spring clip seal 22 is fixed to the liner 16 by spot welds 26. However, spot welding causes a portion of both the liner 16 and the seal 22 to melt to form the weld joint. Consequently, the spring clip seal 22 cannot be easily removed. A portion of the liner 16 including its exit region 14 must be cut along with the spring clip seal 22 in order to remove the spring clip seal 22. During reassembly, the cut spring clip 22 and liner exit region 14 must be rewelded, making the process time consuming and raising concerns of structural integrity.

FIG. 3 shows another known spring clip sealing system. Again, the second diameter 24 of the spring clip 22 is fixed to the liner 16 by spot welds 26. The repair of such a system is difficult because one or more components can obstruct access to the spot weld joint 26. As a result, there is no way that a new spring clip 22 can be attached without cutting the liner 16 apart. Again, the disassembly and reassembly of the interface becomes time-consuming and difficult.

Thus, there is a need for a spring clip system that can facilitate the repair, assembly and/or disassembly of the liner-transition duct interface.

SUMMARY OF THE INVENTION

Aspects of the invention are directed to a turbine engine sealing system. The system includes a liner, a spring clip seal and a spacer. The liner has an outer peripheral surface and an exit end. The spring clip seal has an inner peripheral surface and an outer peripheral surface. The spring clip seal tapers from a first end that has a first diameter to a second end that has a second diameter, which is smaller than the first diameter.

The spacer is disposed between and operatively engages each of the second end of the spring clip seal and the outer peripheral surface of the liner. The spacer is attached to outer peripheral surface of the liner. In one embodiment, the spacer can be attached to the outer peripheral surface of the liner by at least one fillet weld. In such case, the fillet weld can extend substantially continuously about an interface defined between engaging portions of the liner and the spacer. The second end of the spring clip seal is spaced from the outer peripheral surface of the liner. Further, the second end of the spring clip seal can be spaced axially upstream from the exit end of the liner.

In one embodiment, the spacer can be a protrusion that extends from the second end of the spring clip seal. The protrusion and the second end of the spring clip seal can be unitary. In another embodiment, the spacer can be an insert formed separately from the second end of the spring clip seal. In such case, the second end of the spring clip seal can be attached to the insert by at least one fillet weld. The fillet weld can extend substantially continuously about an interface between the spring clip seal and the insert. The liner can include a plurality of passages extending through and about the liner proximate the exit end. The insert can include a plurality of notches. Each notch can be in fluid communication with a respective one of the passages. Thus, air from the combustor flow path can enter the passages.

In another respect, turbine engine sealing system according to aspects of the invention includes a liner, a spring clip seal and a separately-formed insert. The liner has an outer peripheral surface and an exit end. The spring clip seal has an inner peripheral surface and an outer peripheral surface. The spring clip seal tapers from a first end at a first diameter to a second end at a second diameter that is smaller than the first diameter. The second end of the spring clip seal can be spaced axially upstream from the exit end of the liner. The insert is disposed between the second end of the spring clip seal and the outer peripheral surface of the liner.

The second end of the spring clip seal is attached to the insert by a first fillet weld, and the insert is attached to outer peripheral surface of the liner by a second fillet weld. The first fillet weld can extend substantially continuously about an interface between engaging portions of the second end of the spring clip seal and the insert. The second fillet weld can extend substantially continuously about an interface between engaging portions of the outer peripheral surface of the liner and the insert. The insert can have an upstream end and a downstream end. The downstream end of the insert can be attached to outer peripheral surface of the liner by the second fillet weld.

The liner can include a plurality of passages extending through and about the liner proximate the exit end. The insert can include a plurality of notches. Each notch can be in fluid communication with a respective one of the passages. Thus, air from the combustor flow path can enter the passages.

Aspects of the invention are further directed to a method of attaching a spring clip seal. The method includes the step of providing a liner that has an outer peripheral surface and an exit end. A spring clip seal is formed. The spring clip seal has an inner peripheral surface and an outer peripheral surface. The spring clip seal tapers from a first end at a first diameter to a second end at a second diameter, which is smaller than the first diameter. In addition, a spacer is formed. The steps of forming the spring clip seal and the spacer can be performed together such that the spacer and the spring clip seal are unitary.

The spacer is positioned so as to operatively engage both the second end of the spring clip seal and the outer peripheral surface of the liner. A first weld joint is formed to attach the spacer to the outer peripheral surface of the liner. The first weld joint is formed such that the spacer and the liner do not melt. In one embodiment, the step of forming the first weld joint can be performed by fillet welding.

In one embodiment, the spacer can be an insert formed separately from the spring clip seal. In such case, the method according to aspects of the invention can further include the step of forming a second weld joint to attach the spacer to the outer peripheral surface of the liner. The second weld joint forming step can be performed in such a way that the spacer and the liner do not melt. For example, the second weld joint can be formed by fillet welding.

DETAILED DESCRIPTION OF EMBODIMENTS OF THE INVENTION

Embodiments of the present invention are directed to a spring clip seal system that can minimize the difficulties experienced with the repair, assembly and/or disassembly of prior spring clip seal systems. A system according to aspects of the invention can involve the attachment of a spring clip seal to a liner in a manner that can facilitate the separation of the spring clip seal from the liner, such as by using a welding process that does not require the base material of the spring clip seal and the liner to be melted to form the weld joint. Ideally, such a system would not appreciably affect the aerodynamic performance in the region. Embodiments of the invention will be explained in the context of one possible system, but the detailed description is intended only as exemplary. Embodiments of the invention are shown in FIGS. 4-7, but the present invention is not limited to the illustrated structure or application.

Figure 1:
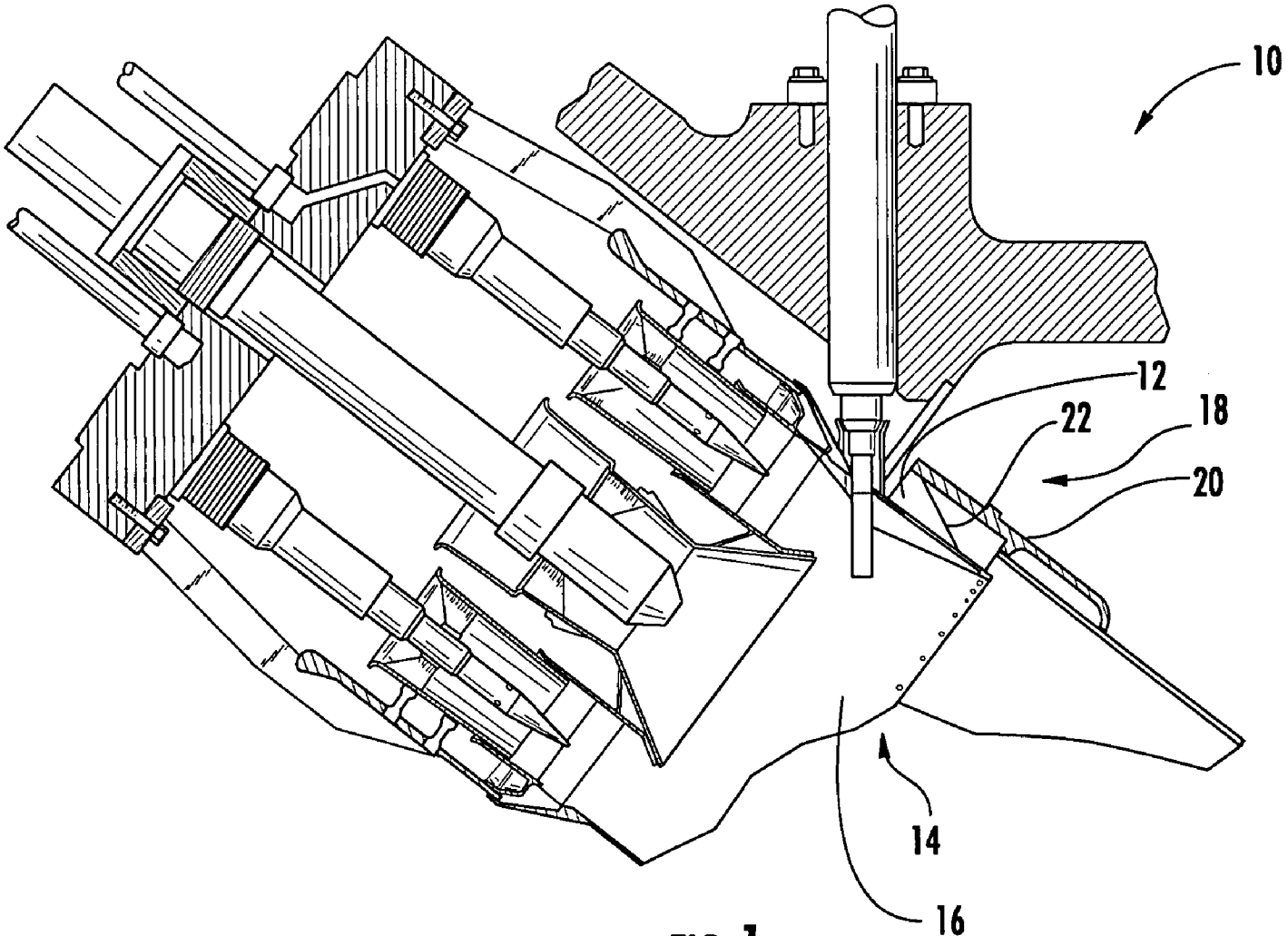
FIG. 1 (PRIOR ART)
FIG. 1 is a cross-sectional view of a portion of the combustor section of a known turbine engine, showing a spring clip seal operatively positioned between the exit end of the combustor basket and the inlet to the transition.
Figure 2:
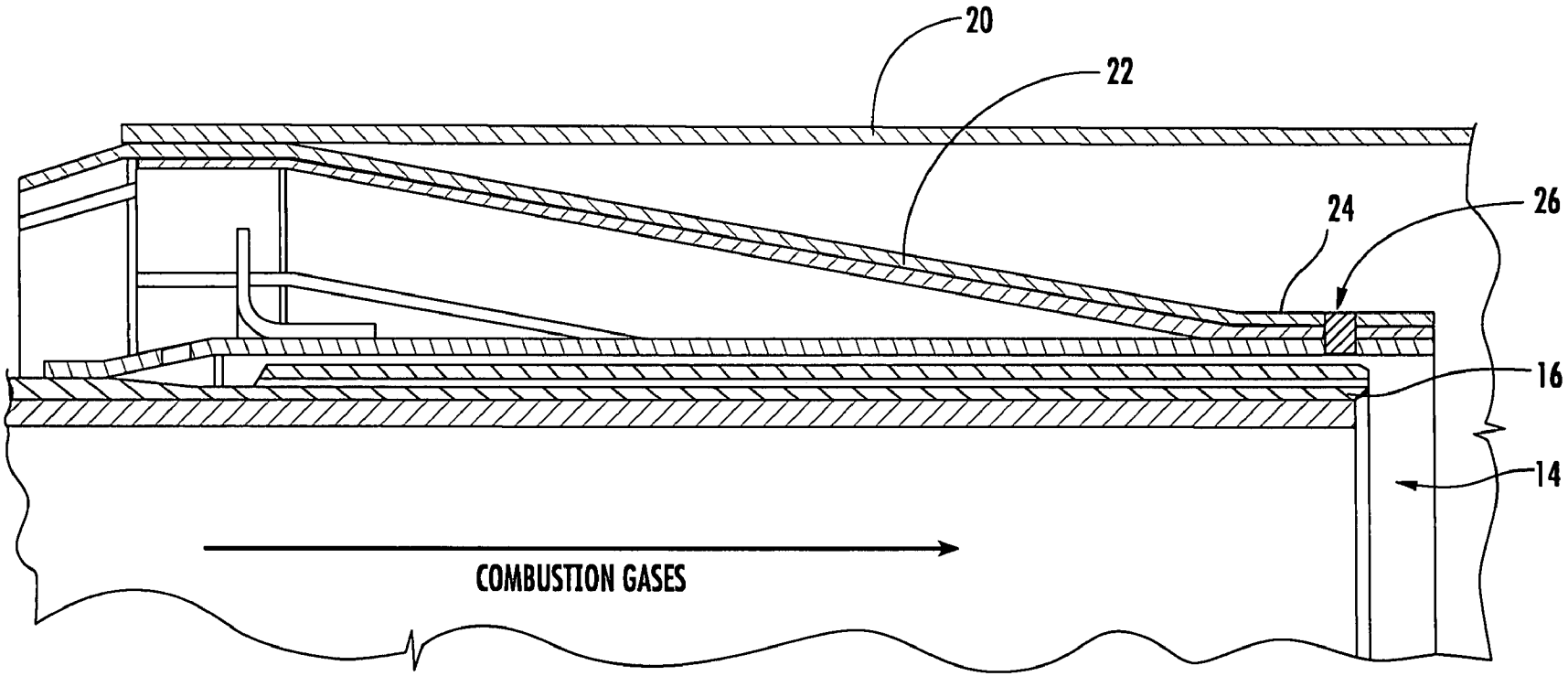
FIG. 2 (PRIOR ART)
FIG. 2 is a close-up cross-sectional view of one known spring clip seal system.
Figure 3:
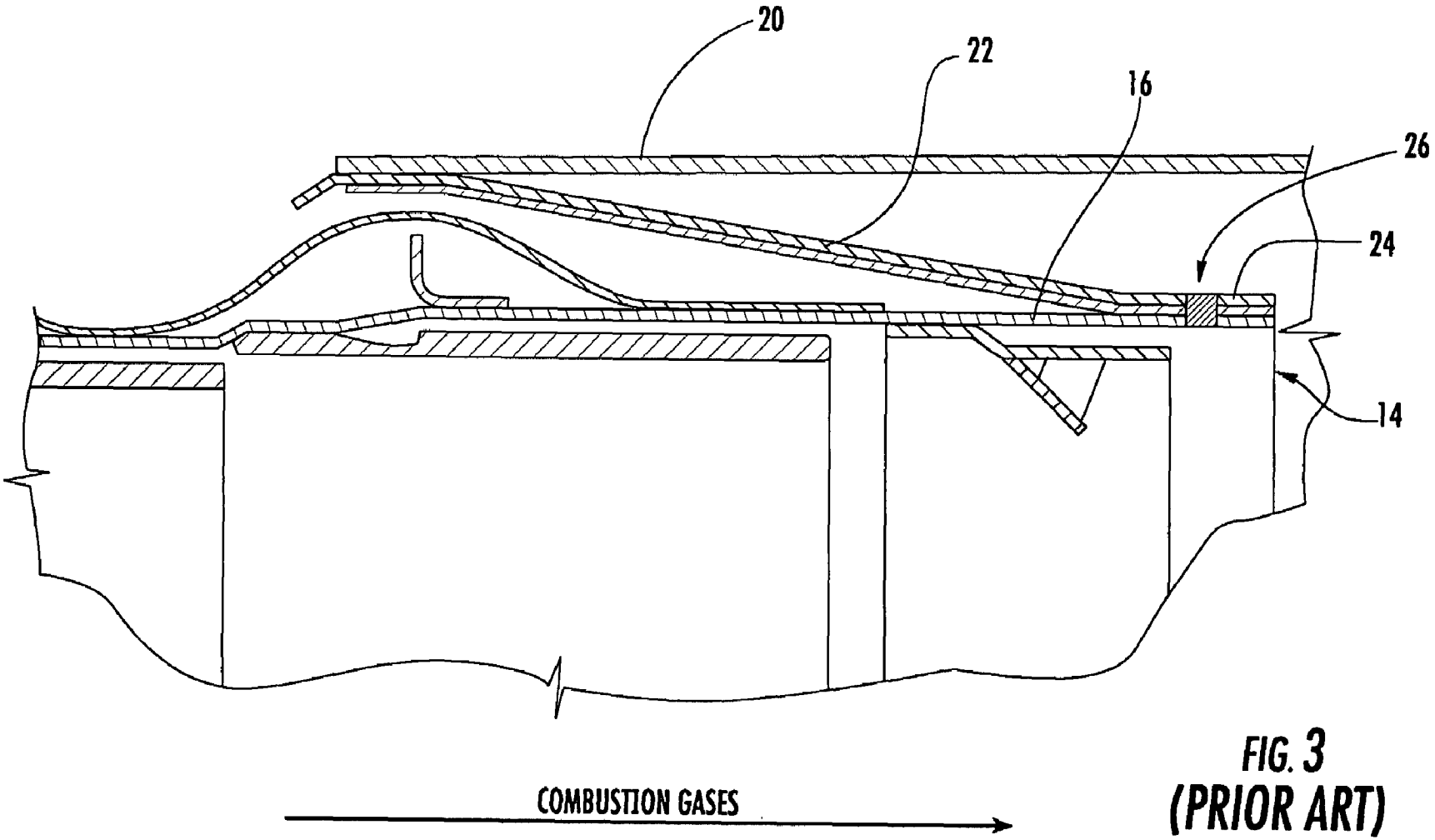
FIG. 3 (PRIOR ART)
FIG. 3 is a close-up cross-sectional view of another known spring clip seal system.
Figure 4:
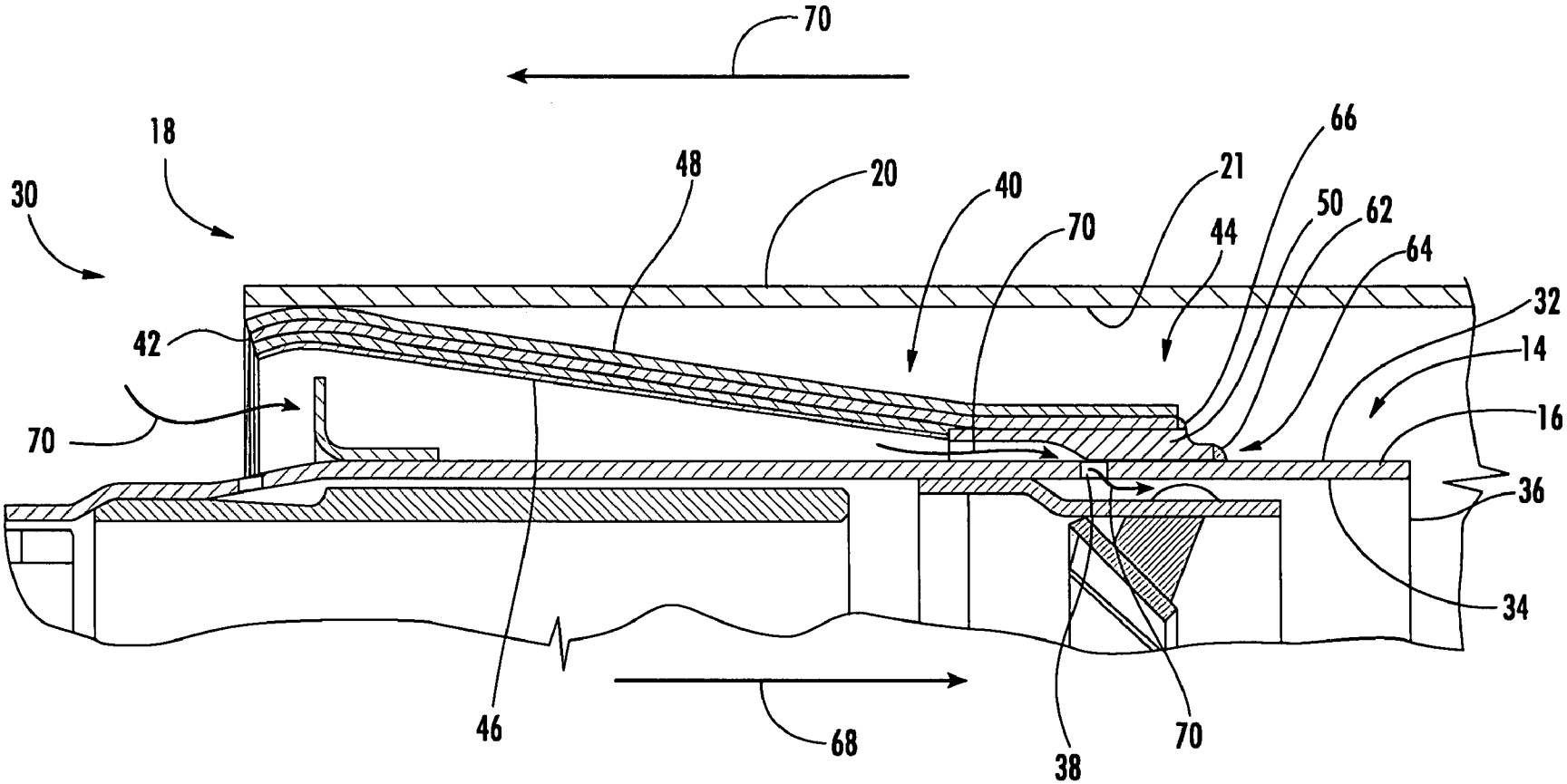
FIG. 4 is a close-up of a spring clip seal system according to aspects of the invention.

FIG. 4 shows one spring clip seal system 30 according to aspects of the invention. The system 30 can be used at the interface between the inlet region 18 of the transition duct 20 and the outlet region 14 of the combustor liner 16. Preferably, the system 30 does not require modifications to be made to the liner 16 and the transition duct 20. The transition duct can have an inner peripheral surface 21. The liner 16 is a generally tubular component having an outer peripheral surface 32, an inner peripheral surface 34, and an exit end 36. A plurality of passages 38 extend through the wall of the liner 16 near the exit end 36.

The sealing system 30 according to aspects of the invention includes a spring clip seal 40. The seal 40 can be generally conical, tapering from a first end 42 having a first diameter to a second end 44 having a second, smaller diameter. However, other conformations are possible. The spring clip seal 40 can have an inner peripheral surface 46 and an outer peripheral surface 48. The spring clip seal 40 can be a single unitary piece, or it can comprise a plurality of nested housings.

The outer peripheral surface 48 of the first end 42 of the spring clip seal 40 can operatively engage the inner peripheral surface 21 of the transition duct 20. The second end 44 of the spring clip seal 40 according to aspects of the invention can be operatively attached to the liner 16 in a way that can facilitate the subsequent separation and removal of the spring clip seal 40. According to aspects of the invention, the second end 44 of the spring clip seal 40 is separated from the outer peripheral surface 32 of the liner 16 by a spacer. The spacer can operatively engage the second end 44 of the spring clip seal 40 and the outer peripheral surface 32 of the liner 16.

Figure 5:
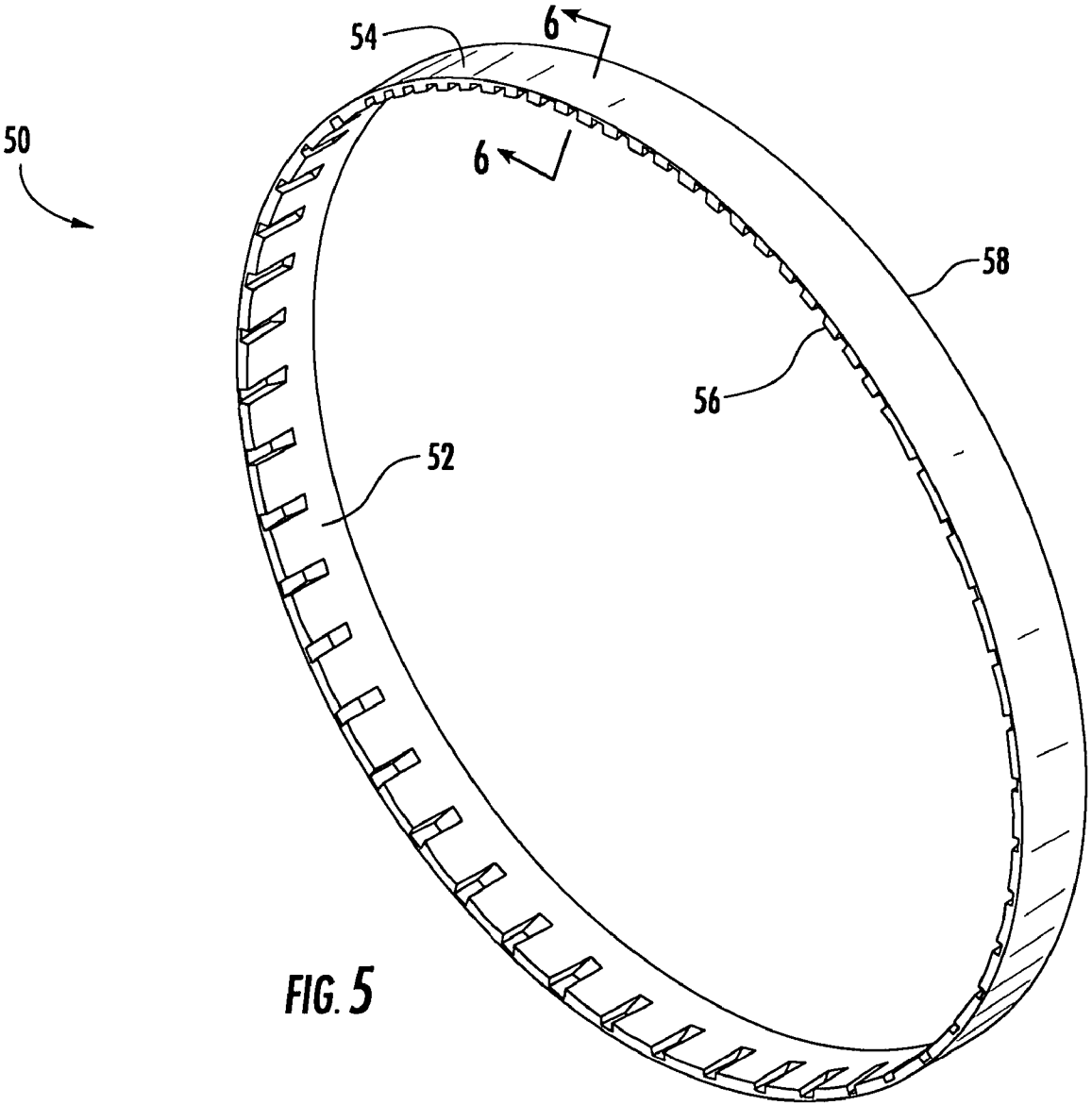
FIG. 5 is an isometric view of an insert according to aspects of the invention.
Figure 6:
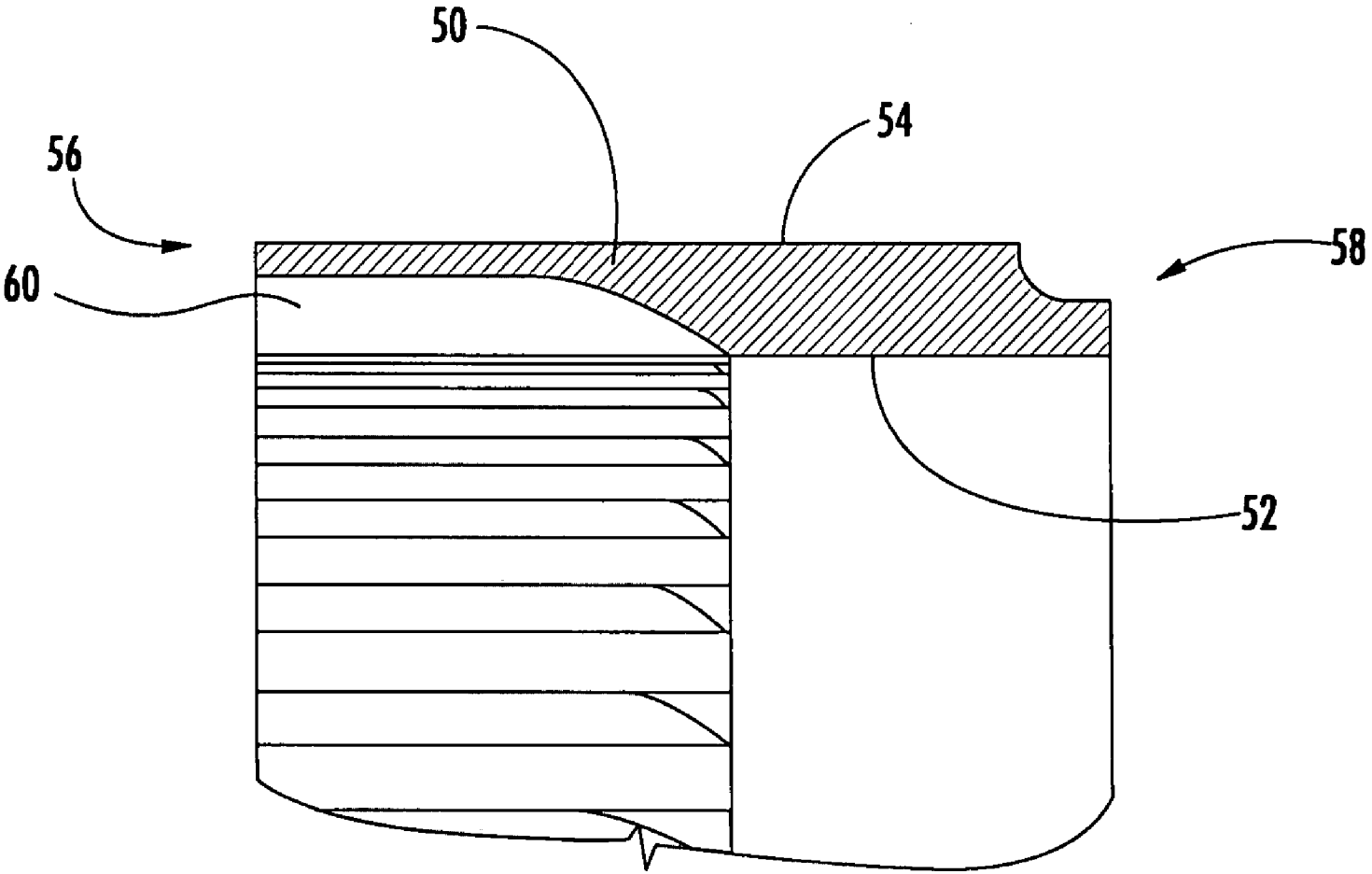
FIG. 6 is a cross-sectional view of the insert according to aspects of the invention, viewed from line 6-6 in FIG. 5.

In one embodiment, the spacer can be an insert 50 that is interposed between the second end 44 of the spring clip seal 40 and the liner 16. Thus, the second end 44 of the spring clip seal 40 can be indirectly attached to the liner 16. One embodiment of an insert 50 according to aspects of the invention is shown in FIGS. 5-6. The insert 50 can be substantially ring-shaped. The insert 50 can have an inner peripheral surface 52 and an outer peripheral surface 54. In addition, the insert 50 can also include an upstream end 56 and a downstream end 58. The insert 50 can be a single unitary piece, or it can be made of a plurality of segments that are circumferentially abutted and connected so as to form a ring. The insert 50 can be made of any suitable material including, for example, HAST-X.

The insert 50 can include a plurality of notches 60 therein. The notches 60 can be formed in the insert 50 so as to begin at the upstream end 56. The notches 60 can extend toward but terminate before the downstream end 58. In addition, the notches 60 can open to the inner peripheral surface 52 of the insert 50. The notches 60 can have any shape and are preferably configured so as to minimize stress concentrations. The notches 60 can be substantially identical to each other, but at least one of the notches 60 can be different from the other notches 60 in one or more respects.

The notches 60 can be spaced about the insert 50 in various ways. Ideally, the notches 60 are positioned to correspond to locations of the passages 38 in the liner 16. In one embodiment, the notches 60 can be substantially equally spaced about the insert 50. In some instances, the notches 60 can be provided at an unequal spacing in one or more areas about the insert 50.

According to aspects of the invention, the insert 50 can be attached to the liner 16 in a way that does not involve the melting of the base material of the liner 16 and/or the insert 50. For instance, a weld material can be deposited at the engaging portions of the liner and the insert to form a weld joint. In one embodiment, the insert 50 can be attached to the liner 16 by a fillet weld 62. More specifically, the downstream end 58 of the insert 50 can be fillet welded to the outer peripheral surface 32 of the liner 16 proximate the exit end 36. Preferably, the fillet weld 62 extends continuously around an interface 64 defined between the engaging portions of the liner 16 and the insert 50, such as a 360 degree fillet weld. However, aspects of the invention include embodiments in which the liner 16 and the insert 50 are attached by intermittent fillet welds. It should be noted that the term "fillet weld" and variants thereof may connote a specific cross-sectional geometry of the weld (i.e., triangular) and of a particular arrangement of the pieces being joined (i.e., at right angles), but aspects of the invention are not limited to any particular cross-sectional geometry of the weld or arrangement of the components being joined.

While the above discussion has been directed to fillet welds, the liner 16 and the insert 50 can be joined by other types of welds, preferably welds that are relatively thin and do not involve melting of the liner 16 and the insert 50. When the insert 50 is attached to the liner 16, the notches 60 in the insert 50 can be in fluid communication with the passages 38 in the liner 16.

The first end 42 of the spring clip seal 40 can be operatively positioned against the inner peripheral surface 21 of the transition duct 20. The second end 44 of the spring clip seal 40 can contact the outer peripheral surface 54 of the insert 50. The second end 44 of the spring clip seal 40 can be attached to the insert 50 in a way that does not involve the melting of the base material of the insert 50 and/or the spring clip seal 40, such as by a fillet weld 66. The above discussion of the attachment between the insert 50 and the liner 16 applies equally to the attachment to the insert 50 and the spring clip seal 40. In one embodiment, the second end 44 of the spring clip seal 40 can be attached at or near the downstream end 58 of the insert 50. Preferably, the second end 44 of the spring clip seal 40 is axially spaced from the exit end 36 of the liner 16.

Figure 7:
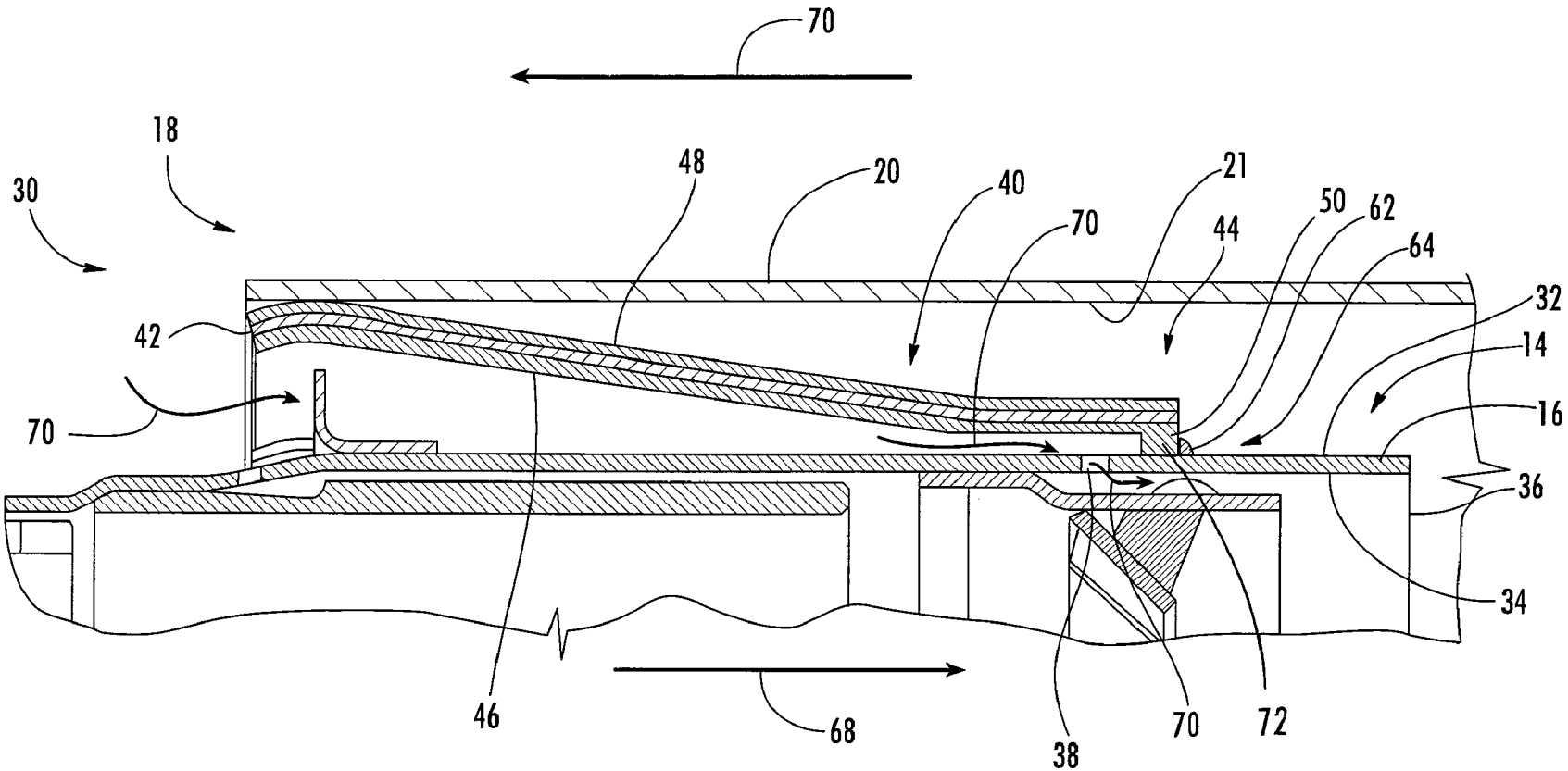
FIG. 7 is a close-up view of an alternative spring clip seal system according to aspects of the invention, showing a spring clip seal adapted for direct engagement with the outer peripheral surface of the liner.

There are other ways in which the second end 44 of the spring clip seal 40 can be operatively attached to the liner 16. In one embodiment, the second end 44 of the spring clip seal 40 can be adapted to be directly attached to the liner 16. To that end, the spacer can be one or more protrusions 72 extending from the second end 44 of the spring clip seal 40, as shown in FIG. 7. The protrusion 72 can be unitary with the second end 44 of the spring clip seal 40; that is, the protrusion 72 and the second end 44 can be a single piece. The protrusion 72 can extend continuously about the entire inner peripheral surface 46 of the spring clip seal 40. The protrusion 72 can also extend substantially radially inward from the inner peripheral surface 46 of the spring clip seal 40. The protrusion 72 can be attached to the liner 16 by any of the processes discussed above, including fillet welds 62. The protrusion can be configured so that it does not block any of the passages 38 in the liner 16.

The above-described system can facilitate the repair of the combustor liner 16 and/or spring clip seal 22, as may be required over the life of the engine. As noted above, fillet welds can be used to join the spring clip seal 40 and the insert 50 and to join the insert 50 and the liner 16. Such welds are relatively easy to cut using any suitable technique. Thus, the spring clip seal 40, insert 50 and liner 16 can be separated from each other without the need for cutting any of these individual components, as was necessary with prior spring clip sealing systems. As a result, component life can be extended and the frequency of repair can be reduced. Further, the time and labor cost associated with the repair, disassembly and reassembly process can be reduced.

Further, it should be noted that there have been instances of the second end of known spring clip seals being burned during engine operation. Such burning can be attributed to the location of the second end of the seals, which may extend substantially to or even beyond the exit end 36 of the liner 16. Consequently, the second end resides close to the hot combustion gas flow. However, the spring clip seal cannot simply be shortened because of the second end of the seal would cover the passages 38 in the liner 16. According to aspects of the invention, the axial length of the spring clip seal 40, measured from the first end 42 to the second end 44, can be shortened so that the second end 44 terminates at or near the passages 38 in the liner 16. However, the passages 38 are not obstructed because the insert 50 keeps the second end 44 off of the outer peripheral surface 32 of the liner 16. The second end 44 can be spaced upstream from the exit end 36 of the liner 16 and, therefore, away from the combustion gas path. The remoteness of the second end 44 can minimize the potential for burning.

It will be appreciated that the above-described system 30 can have little or no impact on the aerodynamic performance of the transition duct-liner interface. The system 30 can direct fluid flow to the passages 38 in the liner 16 while preventing hot combustion gases 68 in the liner 16 from leaking into the combustor air path 70. In addition, the spring clip seal 40 can prevent leakage of compressed air 70 into the combustion gas path 68. The notches 60 in the insert 50 can permit an appropriate amount of the air 70 to enter the passages 38 in the liner 16.

The foregoing description is provided in the context of one possible spring clip seal system. Thus, it will of course be understood that the invention is not limited to the specific details described herein, which are given by way of example only, and that various modifications and alterations are possible within the scope of the invention as defined in the following claims.

What is claimed is:

1. A turbine engine sealing system comprising:

a liner having an outer peripheral surface and an inner peripheral surface, the liner further having an exit end, wherein a plurality of passages extend about the liner proximate the exit end, each passage extending through the liner generally from the outer peripheral surface to the inner peripheral surface;

a spring clip seal having an inner peripheral surface and an outer peripheral surface, the spring clip seal tapering from a first end having a first diameter to a second end having a second diameter that is smaller than the first diameter; and a spacer disposed between and operatively engaging each of the second end of the spring clip seal and the outer peripheral surface of the liner, the spacer being attached to outer peripheral surface of the liner, whereby the second end of the spring clip seal is spaced from the outer peripheral surface of the liner;

wherein the spacer includes a plurality of notches, the spacer being positioned so that each notch is open in the direction opposite the exit of the liner and each notch is closed in the direction of the exit end of the liner effected at least partially by the continuous circumferential contact between a downstream end portion of the spacer and the outer peripheral surface of the liner in a region proximate the exit end thereof, each notch further opends to the outer peripheral surface of the liner, wherein each notch is in fluid communication with a respective one of the passages, whereby air from the combustor flow path can enter the passages.

2. The system of claim 1 wherein the spacer is attached to the outer peripheral surface of the liner by at least one fillet weld.

3. The system of claim 2 wherein the fillet weld extends substantially continuously about an interface defined between engaging portions of the liner and the spacer.

4. The system of claim 1 wherein the second end of the spring clip seal is spaced axially upstream from the exit end of the liner.

5. The system of claim 1 wherein the spacer is an insert formed separately from the second end of the spring clip seal.

6. The system of claim 5 wherein the second end of the spring clip seal is attached to the insert by at least one fillet weld.

7. The system of claim 6 wherein the fillet weld extends substantially continuously about an interface between the spring clip seal and the insert.

8. A turbine engine sealing system comprising:

a liner having an outer peripheral surface and an inner peripheral surface, the liner further having an exit end, wherein a plurality of passages extend about the liner proximate the exit end, each passage extending through the liner generally from the outer peripheral surface to the inner peripheral surface;

a spring clip seal having an inner peripheral surface and an outer peripheral surface, the spring clip seal tapering from a first end having a first diameter to a second end having a second diameter that is smaller than the first diameter; and a separately-formed insert disposed between the second end of the spring clip seal and the outer peripheral surface of the liner, the second end of the spring clip seal being attached to the insert by a first fillet weld, and the insert being attached to outer peripheral surface of the liner by a second fillet welds, wherein the insert includes a plurality of notches, the insert being positioned so that each notch is open in the direction opposite the exit end of the liner and each notch is closed in the direction of the exit end of the liner, effected at least partially by the continuous circumferential contact between a downstream end portion of the inset and the outer peripheral surface of the liner in a region proximate the exit end thereof,each notch further opens to the outer peripheral surface of the liner, wherein each notch is in fluid communication with a respective one of the passages, whereby air from the combustor flow path can enter the passages.

9. The system of claim 8 wherein the second fillet weld extends substantially continuously about an interface between engaging portions of the outer peripheral surface of the liner and the insert.

10. The system of claim 8 wherein the second end of the spring clip seal is spaced axially upstream from the exit end of the liner.

11. The system of claim 8 wherein the first fillet weld extends substantially continuously about an interface between engaging portions of the second end of the spring clip seal and the insert.

12. The system of claim 8 wherein the insert has an upstream end and a downstream end, wherein the downstream end of the insert is attached to outer peripheral surface of the liner by the second fillet weld.

13. A method of attaching a spring clip seal comprising the steps of:

providing a liner having an outer peripheral surface and an exit end;

forming a spring clip seal having an inner peripheral surface and an outer peripheral surface, the spring clip seal tapering from a first end having a first diameter to a second end having a second diameter that is smaller than the first diameter;

forming a spacer, wherein the spacer includes a plurality of notches;

positioning the spacer on the outer peripheral surface of the liner so that the spacer operatively engages each of the second end of the spring clip seal and the outer peripheral surface of the liner, and further so that each notch is open in the direction opposite the exit end of the liner and each notch is closed in the direction of the exit end of the liner effected at least partially by the continuous circumferential contact between a downstream end portion of the spacer and the outer peripheral surface of the liner in a region proximate the exit end thereof, each notch further opens to the outer peripheral suface of the liner, wherein each notch is in fluid communication with a respective one of the passages, whereby air from the combustor flow path can enter the passages; and forming a first weld joint to attach the spacer to the outer peripheral surface of the liner, wherein the first weld joint is formed such that the spacer and the liner do not melt.

14. The method of claim 13 wherein the spacer forming step and the spring clip forming step are performed together such that the spacer and the spring clip seal are unitary.

15. The method of claim 13 wherein the first weld joint forming step is performed by fillet welding.

16. The method of claim 13 wherein the spacer is an insert formed separately from the spring clip seal, and farther including the step of forming a second weld joint to attach the spacer to the outer peripheral surface of the liner, wherein the second weld joint forming step is performed such that the spacer and the liner do not melt.

17. The method of claim 16 wherein the second weld joint forming step is performed by fillet welding.

* * * * *